US007521081B2

(12) United States Patent
Butler et al.

(10) Patent No.: US 7,521,081 B2
(45) Date of Patent: Apr. 21, 2009

(54) METHOD FOR REDUCING REACTIVITY OF FERROALLOYS USED IN FABRICATING COATED STICK WELDING ELECTRODES

(75) Inventors: Kevin Butler, Broadview Heights, OH (US); David M. Fedor, Cleveland Heights, OH (US)

(73) Assignee: Lincoln Global, Inc., Sante Fe Springs, CA (US)

( * ) Notice: Subject to any disclaimer, the term of this patent is extended or adjusted under 35 U.S.C. 154(b) by 371 days.

(21) Appl. No.: 11/331,733

(22) Filed: Jan. 13, 2006

(65) Prior Publication Data

US 2007/0163676 A1 Jul. 19, 2007

(51) Int. Cl.
*B05D 5/12* (2006.01)

(52) U.S. Cl. ..... 427/61; 219/146.31; 148/210

(58) Field of Classification Search ..... 148/26, 148/210; 427/61; 219/146.31
See application file for complete search history.

(56) References Cited

U.S. PATENT DOCUMENTS

| | | | | |
|---|---|---|---|---|
| 2,720,473 | A * | 10/1955 | Donahey | 148/26 |
| 5,332,697 | A * | 7/1994 | Smith et al. | 438/479 |
| 2002/0197455 | A1 * | 12/2002 | Richter et al. | 428/209 |

* cited by examiner

*Primary Examiner*—Roy King
*Assistant Examiner*—Weiping Zhu
(74) *Attorney, Agent, or Firm*—Hahn Loerser & Parks LLP

(57) ABSTRACT

Methods are presented for reducing reactivity of ferroalloys used in the manufacture of stick welding electrodes with ferroalloy coatings, in which surface metal silicon of ferroalloy powder is stabilized by dissolving or prereacting the surface silicon or silicon dioxide to provide stabilized ferroalloy powder with decreased surface reactivity to caustic silicate solutions that can be mixed with silicate solution to form a slurry for coating precut welding rods.

22 Claims, 4 Drawing Sheets

METHOD FOR REDUCING REACTIVITY OF FERROALLOYS USED IN FABRICATING COATED STICK WELDING ELECTRODES

FIELD OF THE INVENTION

The present invention relates generally to the welding arts and more particularly to methods for reducing reactivity of ferroalloys to basic solutions in the manufacture of coated stick welding electrodes.

BACKGROUND OF THE INVENTION

Stick welding electrodes are used in a variety of welding applications. Stick electrodes are comprised of a metal alloy rod, typically made of low alloy steel or stainless steel, over which a coating is applied that includes various chemicals included to enhance the welding process. In fabricating coated stick welding electrodes, the metal rod is precut into sticks of a predetermined length, and a metal alloy powder is mixed with a silicate binder solution, which is then extruded onto the precut rods to provide the electrode coating. In use, the stick electrode material composition and construction has an impact on the finished weld joint, where surface defects such as cracks in the electrode coating layer can adversely affect the performance of the electrode and the finished weld. Ferroalloy powders are commonly employed in making the coatings of stick electrodes, where metal silicon is often found in the exposed outer surfaces of the powder grains. The powder is mixed with a caustic silicate binding solution to form a slurry for application to the outer surfaces of the precut welding rods. However, the metal silicon of the ferroalloy powder is highly reactive to the caustic binder solution, resulting in the release of gases that lead to weakened and/or fractured coatings. Accordingly, there is a need for improved methods for reducing the reactivity of ferroalloys, such as ferroalloy powders used in manufacturing coated stick electrodes, so as to mitigate or avoid cracking or other coating defects.

SUMMARY OF INVENTION

Various aspects of the invention are hereinafter summarized in order to facilitate a basic understanding thereof, wherein this summary is not an extensive overview of the invention, and is intended neither to identify certain elements of the invention, nor to delineate the scope of the invention. Rather, the primary purpose of the summary is to present some concepts of the invention in a simplified form before a more detailed description is presented below. The present invention is related to methods for reducing reactivity of ferroalloys used in the manufacture of coated stick welding electrodes in order to lessen the likelihood of gas-producing reaction of the coating powder when mixed with the silicate binding agent, thereby mitigating cracks or other surface defects in the electrode coating. Unlike other techniques in which the alloy powder is coated prior to mixture with the binder, the techniques of the invention operate to stabilize surface metal silicon of ferroalloy powder by dissolving or prereacting the surface silicon prior to mixture with the silicate binding solution. The invention can thus be employed to combat surface defects in stick electrode coatings and thereby enhance welding electrode performance and finished weld joint integrity without the inclusion of coating materials into the manufacturing process or into the finished electrode product.

In accordance with one or more aspects of the invention, a method is provided for coated stick welding electrode manufacturing, in which a ferroalloy powder is provided that includes surface metal silicon, such as silicon (Si) or silicon dioxide ($SiO_2$ or stoichiometric variants thereof), collectively referred to hereinafter as surface metal silicon. The method includes stabilizing the ferroalloy powder to produce stabilized powder with reduced or decreased surface reactivity to caustic silicate solutions, and thereafter mixing the stabilized powder with a silicate binder solution, such as sodium silicate (e.g., $Na_2SiO_3$) to form a slurry. A precut metal alloy welding rod is then extruded with the slurry to produce a coated stick welding electrode. The ferroalloy powder may be stabilized by a variety of techniques, including dissolving the surface metal silicon in a caustic solution or reacting the exposed surface metal silicon to form a different (less reactive) compound, such as silicon nitride, silicon carbide, etc., prior to mixing the stabilized powder with the silicate binder solution. In this manner, the slurry mixture and the application to the precut welding rods is less likely to exhibit release of hydrogen gas and the resulting coated electrode is less likely to have cracks or other defects in the coating layer. In one implementation, the surface metal silicon is dissolved by mixing the ferroalloy powder with a heated sodium hydroxide solution, and the stabilized powder is then rinsed with water. In another example, the surface metal silicon of the ferroalloy powder is reacted with nitrogen (N) to form surface silicon nitride (e.g., $Si_3N_4$), or with carbon (C) to form surface silicon carbide (SiC) to produce the stabilized powder.

Another aspect of the invention provides a method for decreasing or reducing reactivity of ferroalloys for use in manufacturing coated stick welding electrodes. The method involves providing a ferroalloy powder having grains with silicon or silicon dioxide on the surface (surface metal silicon), and dissolving the surface metal silicon to produce a stabilized powder with decreased surface reactivity to caustic silicate solutions. The metal silicon on the powder grain surface can be dissolved by mixing the powder with a heated caustic solution and rinsing the powder with water to produce the stabilized powder. Yet another aspect of the invention provides a method for reducing reactivity of ferroalloys for use in manufacturing coated stick welding electrodes, including reacting the surface metal silicon to produce a stabilized powder with decreased surface reactivity to caustic silicate solutions. In one example, the surface metal silicon is reacted with nitrogen to form surface silicon nitride to produce the stabilized powder. In another exemplary implementation, the surface metal silicon is reacted With carbon to form surface silicon carbide to produce the stabilized powder.

BRIEF DESCRIPTION OF THE DRAWINGS

The following description and drawings set forth certain illustrative implementations of the invention in detail, which are indicative of several exemplary ways in which the principles of the invention may be carried out. Other objects, advantages and novel features of the invention will become apparent from the following detailed description of the invention when considered in conjunction with the drawings, in which.

DETAILED DESCRIPTION OF THE INVENTION

Figure 1:
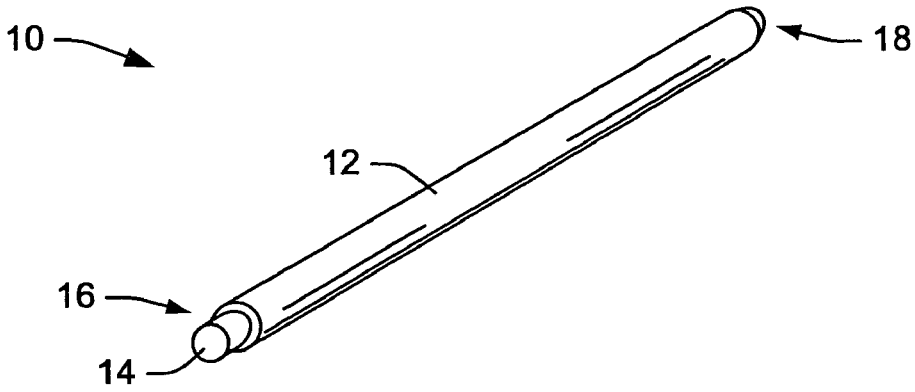
FIG. 1 is a perspective view illustrating an exemplary coated stick welding electrode that may be fabricated according to the methods of the present invention.
Figure 2:
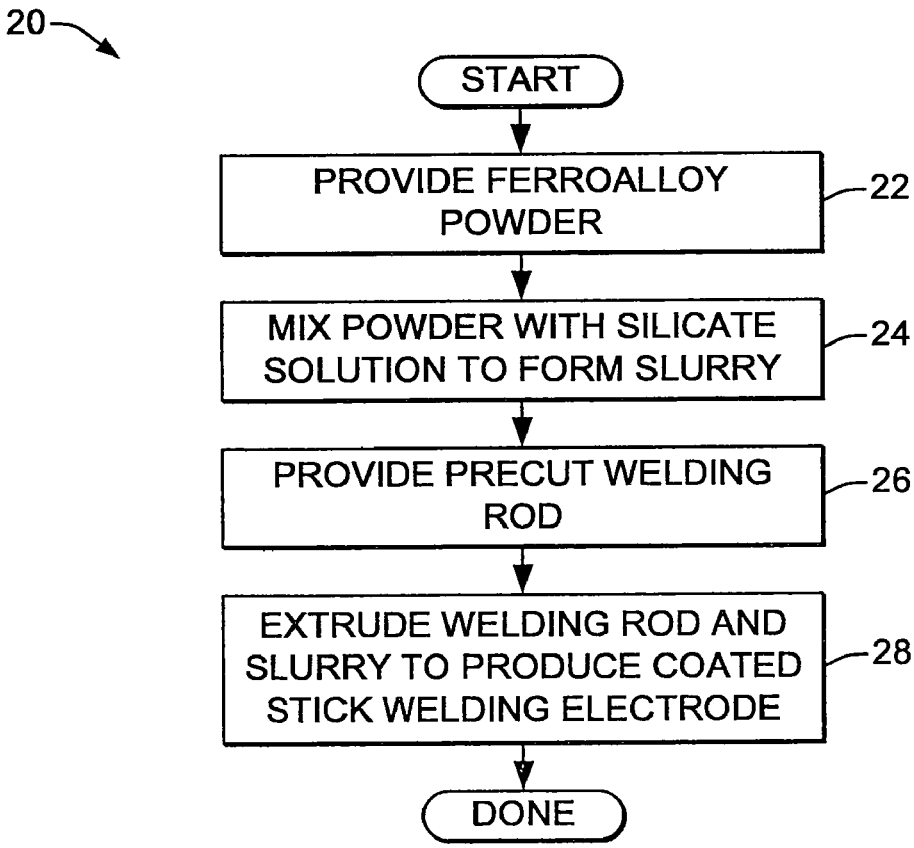
FIG. 2 is a flow diagram illustrating a general stick electrode manufacturing process in which the invention may be carried out.

One or more embodiments or implementations of the present invention are hereinafter described in conjunction with the drawings with like reference numerals being used to refer to like elements throughout, where the illustrated structures are not necessarily drawn to scale. The invention may be employed in the manufacture of any type of coated stick welding electrodes, in which ferroalloy powder is used in creating an electrode coating. FIG. 1 depicts an exemplary coated stick welding electrode 10, including an outer coating 12 surrounding a metallic inner core 14, where coating 12 may include binding materials, flux materials, alloying agents, and/or organic materials designed to establish certain chemical or structural characteristics of the electrode 10 and/or to enhance a welding process in which the electrode 10 is to be used. Electrode 10 includes a hold end 16 with a reduced diameter for electrical connection to a power source cable clamp, as well as a strike end 18 that is machined or ground to remove coating 12 from a portion thereof to facilitate arc starting in use. FIG. 2 illustrates a simplified process for producing the electrode 10 of FIG. 1, in which one or more aspects of the invention may be carried out. In the process 20, a ferroalloy powder is provided at 22, which is then mixed with a silicate binder solution at 24 to form a slurry. A precut welding rod is provided at 26, and the welding rod is then extruded with the slurry at 28 to coat the welding rod, thereby creating a coated stick welding electrode 10. Other processing steps may also be performed (not shown), such as grinding or machining to create the hold end 16 and strike end 18 as shown in FIG. 1. It is noted in FIG. 2 that absent countermeasures, mixture of the ferroalloy powder with the silicate binder solution at 24 may cause a reaction in which exposed metal silicon (e.g., elemental silicon (Si), silicon dioxide ($SiO_2$) or stoichiometric variants thereof, etc.) on the surface of the ferroalloy powder grains reacts with the caustic silicate binder, causing release of hydrogen gases or other byproducts that may adversely impact the structural integrity of the resulting electrode coating 12. For example, as discussed above, the release of the gases during production of the electrode 10 may lead to weak spots and/or fractures in the coating 12. These coating defects, in turn, may degrade the performance of the electrode and negatively impact weld joints created therewith.

The present invention accordingly provides techniques by which the adverse effects of released hydrogen gases or other byproducts during electrode fabrication can be mitigated by stabilizing the ferroalloy powder prior to mixture with the binder and application to the precut welding rods. Any suitable stabilization technique can be employed within the scope of the invention by which the surface reactivity of the ferroalloy powder to caustics is reduced without application of surface coatings to the powder grains. In this manner, the adverse effects of reactions with the silicate binder can be avoided or mitigated without the addition of undesirable coating materials to the finished electrode 10 or to the production process used to make the electrode 10. The invention may be carried out using any type of powder ferroalloy materials, including but not limited to alloys of iron and one or more other elements, such as titanium, silicon, manganese, etc., or any ferroalloy material that can be used in the manufacture of welding electrodes (e.g., ferrotitanium, ferrosilicon, ferromanganese, ferromanganese silicon, etc.). In addition, the precut welding rods (e.g., metallic inner core 14) used in producing the electrodes 10 may be of any suitable size, shape, and materials that are suitable for use in welding operations, for example, stainless steel, low alloy steels, other types of metal alloys, etc. Moreover, the invention finds utility in association with any type of caustic binder material used in adhering the coating 12 to the electrode core 14, including but not limited to sodium silicate (e.g., $Na_2SiO_3$ (waterglass)) that has a tendency to react with uncoated or unstabilized surface metal silicon. In this regard, surface metal silicon, as used herein, includes any silicon-containing surface material, such as elemental silicon, silicon dioxide, etc. that is reactive to caustic (basic) materials.

Figure 3:
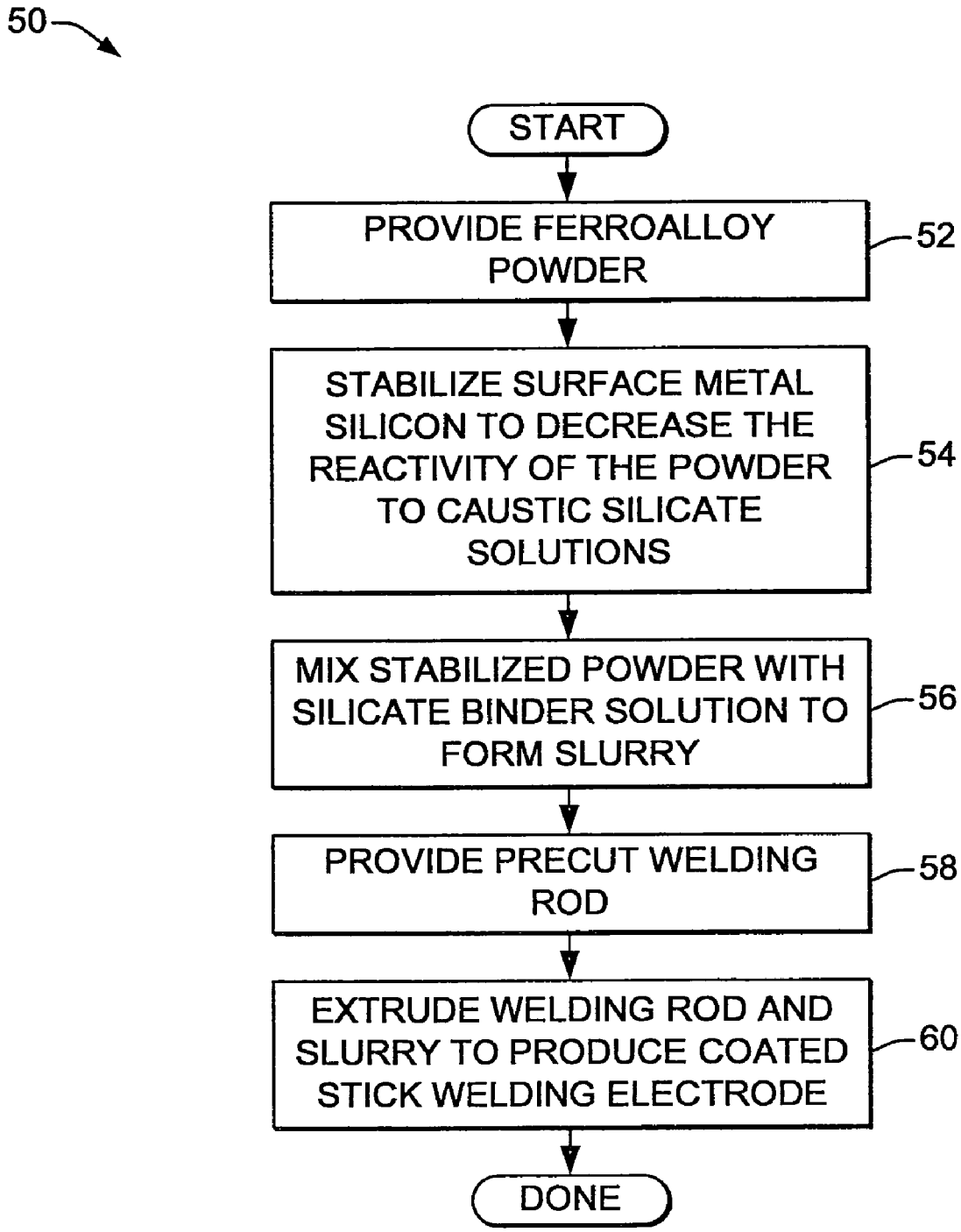
FIG. 3 is a flow diagram illustrating an exemplary method for manufacturing coated stick welding electrodes in which surface metal silicon of ferroalloy powder is stabilized prior to mixture with the binder solution in accordance with one or more aspects of the present invention.

FIG. 3 illustrates an exemplary method 50 for manufacturing coated stick welding electrodes, such as the electrode 10 of FIG. 1 above. Although the exemplary method 50 and other methods of the invention are illustrated and described as a series of acts or events, the methods of the present invention are not limited by the illustrated ordering of such acts or events unless otherwise indicated herein. For example, some acts may occur in different orders and/or concurrently with other acts or events apart from those illustrated and/or described herein, in accordance with the invention. In addition, not all illustrated steps may be required to implement a method in accordance with the present invention. Furthermore, the methods of the invention may be carried out in association with the manufacture of various types of stick welding electrodes 10 illustrated and described herein, as well as in association with other electrodes or production methodologies or materials not illustrated or specifically discussed. Method 50 begins at 52 with provision of a ferroalloy powder that includes surface metal silicon. At 54, the surface metal silicon of the powder is stabilized to produce stabilized powder with decreased surface reactivity to caustic silicate solutions. The stabilized powder is then mixed at 56 with a silicate binder solution, such as waterglass (sodium silicate or $Na_2SiO_3$) to form a slurry. A precut welding rod is provided at 58 and the rod is extruded with the slurry at 60 to produce a coated stick welding electrode.

Figure 4:
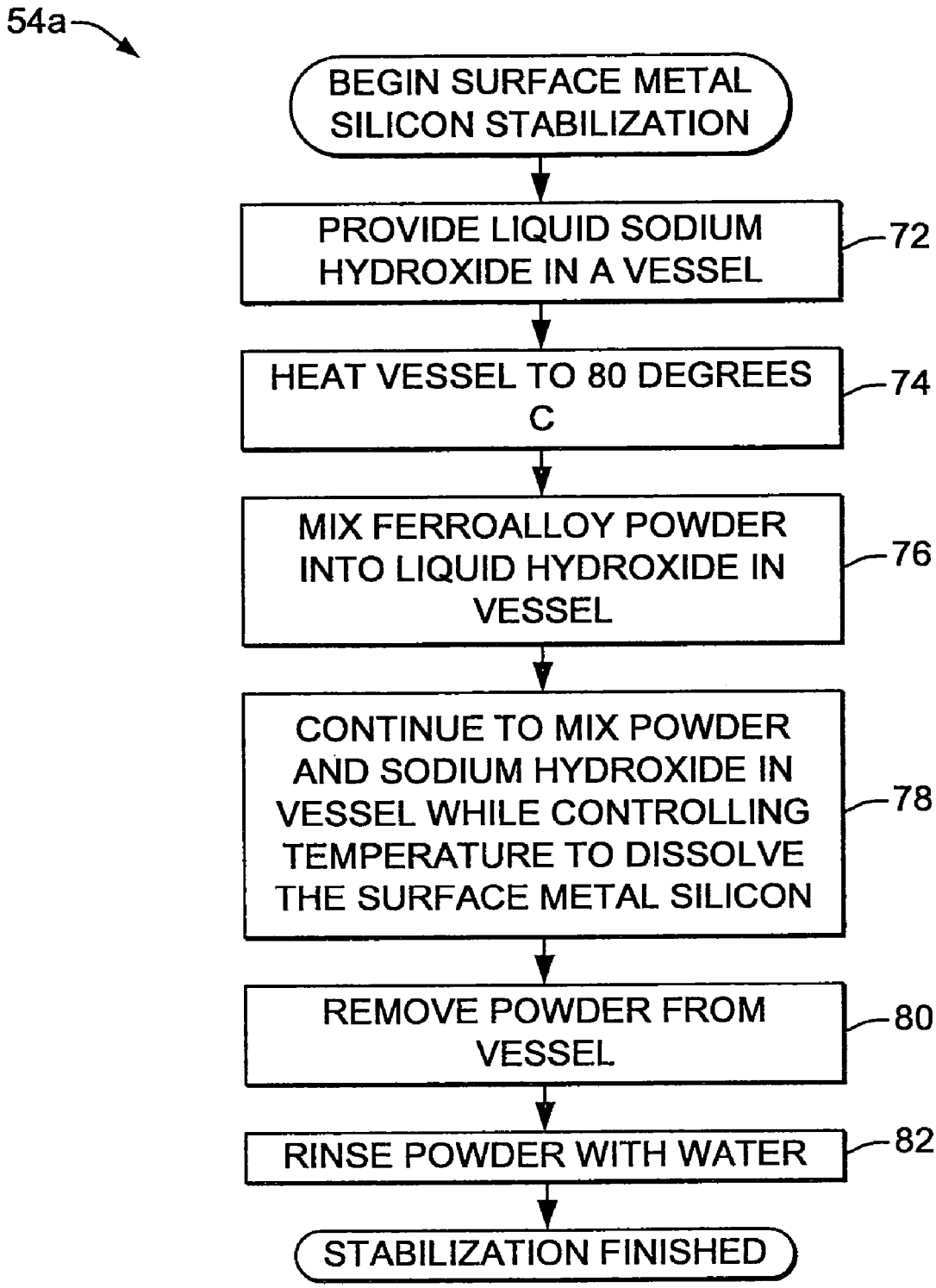
FIG. 4 is a detailed flow diagram illustrating an exemplary surface metal silicon stabilization technique in which the surface metal silicon of the ferroalloy powder is dissolved in a caustic solution to create a stabilized powder prior to mixture with the binder.
Figure 5:
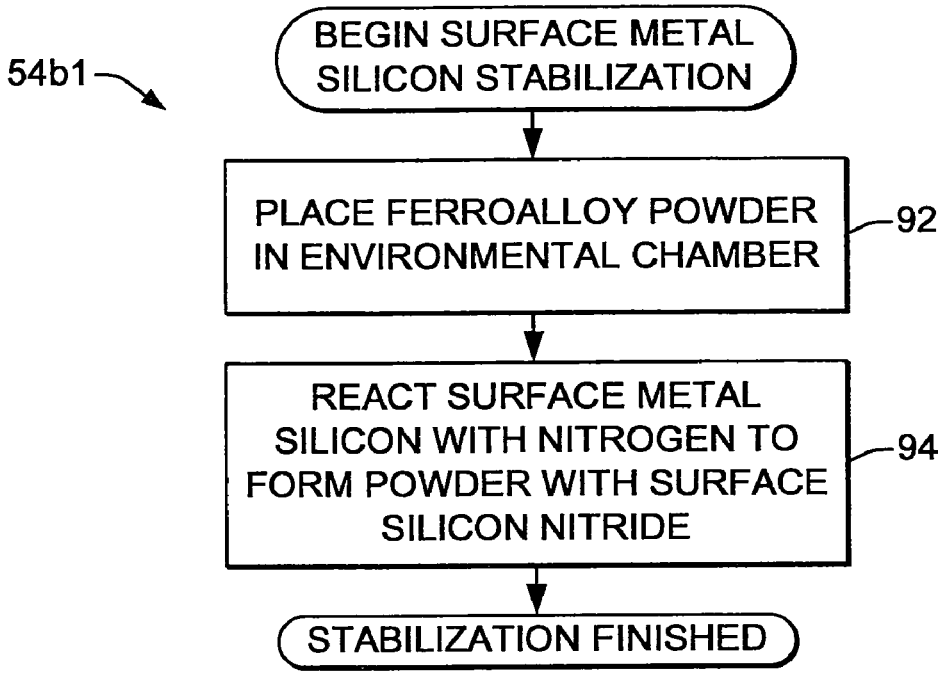
FIGS. 5 and 6 illustrate two exemplary stabilization techniques in which the surface metal silicon is prereacted to form a stabilized ferroalloy powder with reduced reactivity to the caustic silicate binder solution in accordance with the invention.
Figure 6:
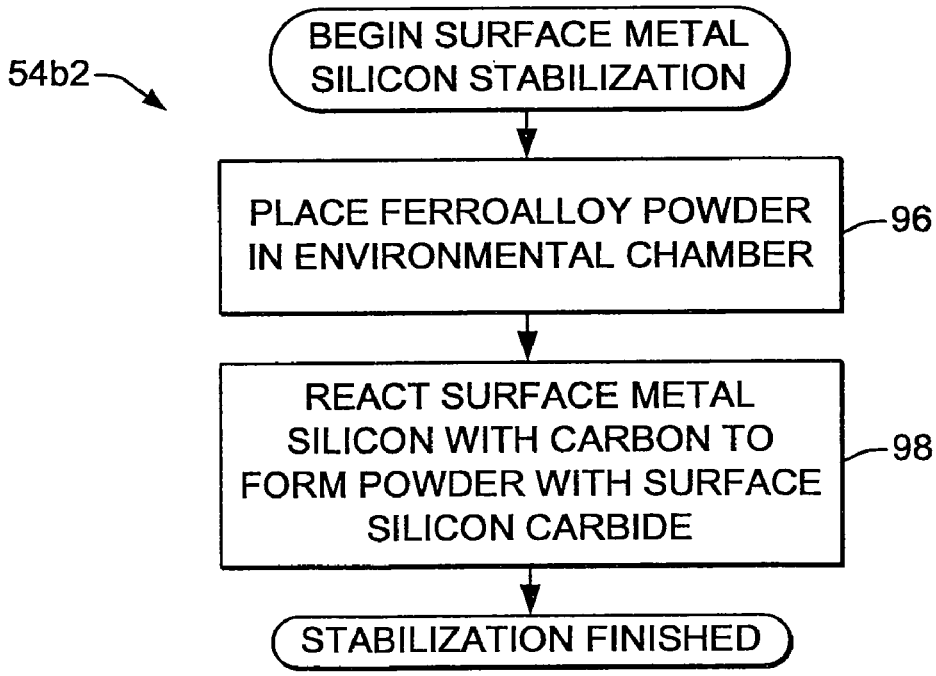

Referring also to FIGS. 4-6, the stabilization of the surface metal silicon at 54 may include various techniques other than coating the powder surface, for example, wherein FIG. 4 illustrates an example 54*a* in which the surface metal silicon is dissolved prior to mixing the stabilized ferroalloy powder with the binder, and FIGS. 5 and 6 illustrate two exemplary techniques 54*b* for prereacting the surface metal silicon to form a stabilized ferroalloy powder. A first exemplary stabilization process 54*a* is shown in FIG. 4, in which a caustic solution, such as liquid sodium hydroxide (NaOH), is provided in a vessel or other container at 72, and the vessel is heated to 80 degrees C. at 74. Other temperatures and caustic solutions can be used, where the implementations illustrated and described herein are merely examples. The ferroalloy powder is added at 76 and the powder and caustic solution are mixed at 78 while controlling the temperature to dissolve all or at least some of the surface metal silicon of the ferroalloy powder. The dissolving process may be continued at 78 for any suitable amount of time, which may vary according to the type of caustic used, the temperature, and relative amounts of powder and caustic solution, after which the powder is removed from the vessel at 80 and rinsed with water at 82. Thereafter, the stabilized powder can be mixed with a silicate binder solution (e.g., at 56 in FIG. 3 above), wherein the stabilization 54*a* in FIG. 4 advantageously reduces the reactivity of the stabilized powder to caustics such as silicate binder solutions to decrease the likelihood or amount of hydrogen gas release during production of coated stick electrodes and thereby mitigates surface coating defects (e.g., cracks, weak spots, etc.) therein. In this implementation, selective dissolution in hot caustic is believed to cause silicon or silicon dioxide on the powder surface to dissolve, leaving the rest of the powder substantially free of surface elemental Si or $SiO_2$ (substantially free of surface metal silicon). In one example, a caustic solution is used comprising about 75 g/liter of sodium hydroxide heated to about 80 degrees C. at 72-78, although this is not a strict requirement of the invention. Other dissolving techniques can be used where the ferroalloy powder is mixed with a heated caustic solution to dissolve the surface metal silicon, wherein all such alternative implementations are contemplated as falling within the scope of the present invention and the appended claims. The invention thus provides modified stick welding manufacturing techniques as well as methods for reducing reactivity of ferroalloys destined for use in the production of stick electrodes, in which a ferroalloy powder is provided that has grains with surface silicon or surface silicon dioxide, and the surface silicon or surface silicon dioxide is dissolved, in whole or in part, to produce a stabilized powder with decreased surface reactivity to caustic silicate solutions.

In another aspect of the invention, the ferroalloy powder may be stabilized to reduce the reactivity thereof to caustics by prereacting the surface metal silicon of the powder at 54 in FIG. 3 with a material that makes the surface inert (non reactive) with respect to the binder solution prior to creating the slurry at 56. FIGS. 5 and 6 illustrate two such examples 54*b*1 and 54*b*2 in which the powder is reacted with nitrogen and carbon, respectively. In the example 54*b*1 of FIG. 5, the ferroalloy powder is placed in an environmental chamber at 92 and the surface metal silicon thereof is reacted with nitrogen (N) at 94 to form surface silicon nitride (e.g., $Si_3N_4$ or stoichiometric variants thereof) to produce stabilized powder with reduced reactivity to caustics such as the silicate binder solution. While the above described dissolving techniques of FIG. 4 tend to remove the metal silicon (Si, $SiO_2$, etc.) from the powder surface, the prereaction technique of FIG. 5 instead exposes the ferroalloy powder to nitrogen at a controlled temperature within the chamber such that the surface metal silicon forms silicon nitride, which is not reactive with the caustic (e.g., the nitride does not release hydrogen gas when mixed with the silicate binder). This reaction process consumes some or all of the silicon or silicon dioxide, whereby the stabilized ferroalloy powder has reduced reactivity with respect to the binder. In one example, the dry powder is placed in an oven with a nitrogen supply, such as nitrogen source gas, or liquid nitrogen with a vaporizer for large scale production, and the temperature of the oven chamber is controlled to induce the nitridation reaction at the grain surfaces of the powder and to thereby produce nonreactive (e.g., inert) silicon nitride $Si_3N_4$.

Another possible implementation is shown in FIG. 6, in which a prereaction 54*b*2 is undertaken to react the surface metal silicon with carbon (C) to produce surface silicon carbide (e.g., SiC or stoichiometric variations thereof. At 96 in FIG. 6, the ferroalloy powder is placed in an environmental chamber and the surface metal silicon of the powder is reacted at 98 with carbon to form surface silicon carbide to produce the stabilized powder, wherein the powder may be exposed to a carbon containing ambient using any suitable processing techniques at 98, such as providing a carbon-containing source gas to the chamber at a suitable temperature in order to induce the reaction of the surface Si or $SiO_2$ with the gas to form stabilized ferroalloy powder having less surface metal silicon, which is preferably replaced by silicon carbide on the exposed powder grain surfaces. The above prereaction methods of FIGS. 5 and 6 are merely examples of this aspect of the invention, wherein the surface metal silicon may alternatively be reacted with other materials that render the powder grain surface nonreactive or less reactive to caustics, wherein all such alternative implementations are contemplated as falling within the scope of the invention and the appended claims. Related aspects of the invention provide methods for reducing reactivity of ferroalloys for use in manufacturing coated stick welding electrodes, which comprise providing a ferroalloy powder having grains with surface silicon or surface silicon dioxide, and reacting the surface with nitrogen, carbon, or other suitable material to produce a stabilized powder with decreased surface reactivity to caustic silicate solutions.

The invention has been illustrated and described with respect to one or more exemplary implementations or embodiments, although equivalent alterations and modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the illustrated implementations of the invention. In addition, although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising".

The invention claimed is:

1. A method for manufacturing coated stick welding electrodes, said method comprising:

providing a ferroalloy powder that includes surface metal silicon;

stabilizing said powder to produce stabilized powder with decreased surface reactivity to caustic silicate solutions;

mixing said stabilized powder with a silicate binder solution to form a slurry; and extruding a precut metal alloy welding rod with said slurry to produce a coated stick welding electrode.

2. A method as defined in claim 1, wherein stabilizing said surface metal silicon comprises dissolving said surface metal silicon of said powder to produce said stabilized powder;

wherein dissolving said surface metal silicon comprises mixing said ferroalloy powder with a heated caustic solution to dissolve said surface metal silicon, and rinsing said powder with water to produce said stabilized powder with decreased reactivity to caustic silicate solutions.

3. A method as defined in claim 2, wherein said heated caustic solution includes sodium hydroxide heated to about 80 degrees C. or more.

4. A method as defined in claim 1, wherein stabilizing said surface metal silicon comprises reacting said surface metal silicon of said powder to produce said stabilized powder.

5. A method as defined in claim 4, wherein reacting said surface metal silicon of said powder comprises reacting said surface metal silicon with nitrogen to form surface silicon nitride to produce said stabilized powder.

6. A method as defined in claim 5, wherein reacting said surface metal silicon with nitrogen comprises placing said ferroalloy powder in an environmental chamber and exposing said ferroalloy powder to nitrogen at a controlled temperature within said chamber.

7. A method as defined in claim 4, wherein reacting said surface metal silicon of said powder comprises reacting said surface metal silicon with carbon to form surface silicon carbide to produce said stabilized powder.

8. A method as defined in claim 7, wherein reacting said surface metal silicon with nitrogen comprises placing said ferroalloy powder in an environmental chamber and exposing said ferroalloy powder to nitrogen at a controlled temperature within said chamber.

9. A method as defined in claim 4, wherein said silicate binder solution comprises sodium silicate.

10. A method as defined in claim 2, wherein said silicate binder solution comprises sodium silicate.

11. A method as defined in claim 1, wherein said silicate binder solution comprises sodium silicate.

12. A method as defined in claim 11, wherein said ferroalloy powder comprises grains having surface metal silicon comprising silicon or silicon dioxide prior to stabilization.

13. A method as defined in claim 4, wherein said ferroalloy powder comprises grains having surface metal silicon comprising silicon or silicon dioxide prior to stabilization.

14. A method as defined in claim 2, wherein said ferroalloy powder comprises grains having surface metal silicon comprising silicon or silicon dioxide prior to stabilization.

15. A method as defined in claim 1, wherein said ferroalloy powder comprises grains having surface metal silicon comprising silicon or silicon dioxide prior to stabilization.

16. A method as defined in claim 1, wherein the ferroalloy powder includes at least one of ferrotitanium, ferrosilicon, ferromanganese, and ferromanganese silicon.

17. A method for reducing reactivity of ferroalloys for use in manufacturing coated stick welding electrodes, said method comprising:

providing a ferroalloy powder having grains with surface silicon or surface silicon dioxide; and dissolving said surface silicon or surface silicon dioxide to produce a stabilized powder with decreased surface reactivity to caustic silicate solutions.

18. A method as defined in claim 17, wherein dissolving said surface silicon or surface silicon dioxide comprises mixing said ferroalloy powder with a heated caustic solution to dissolve said surface silicon or surface silicon dioxide, and rinsing said powder with water to produce said stabilized powder.

19. A method as defined in claim 18, wherein said heated caustic solution includes sodium hydroxide heated to about 80 degrees C. or more.

20. A method for reducing reactivity of ferroalloys for use in manufacturing coated stick welding electrodes, said method comprising:

providing a ferroalloy powder having grains with surface silicon or surface silicon dioxide;

reacting said surface silicon or surface silicon dioxide to produce a stabilized powder with decreased surface reactivity to caustic silicate solutions.

21. A method as defined in claim 20, wherein said surface silicon or surface silicon dioxide is reacted with nitrogen to form surface silicon nitride to produce said stabilized powder.

22. A method as defined in claim 20, wherein said surface silicon or surface silicon dioxide is reacted with carbon to form surface silicon carbide to produce said stabilized powder.

* * * * *